US005996825A

United States Patent [19]

Gordon et al.

[11] Patent Number: 5,996,825

[45] **Date of Patent: *Dec. 7, 1999**

[54] BI-NESTABLE CONTAINER FOR CONSUMABLES

[75] Inventors: David Gordon, Groton; James J. Falzarano, Melrose; Albert F. Madonna, Tyngsboro, all of Mass.

[73] Assignee: WNA Comet East, Inc., Chelmsford, Mass.

[ * ] Notice: This patent is subject to a terminal disclaimer.

[21] Appl. No.: 09/110,054

[22] Filed: Jul. 3, 1998

Related U.S. Application Data

[63] Continuation of application No. 08/691,215, Aug. 1, 1996, Pat. No. 5,842,590.

[51] Int. Cl.[6] ..... A47G 19/23

[52] U.S. Cl. ..... 215/10; 215/377; 206/509; 220/630

[58] Field of Search ..... 215/10, 372, 374, 215/376, 377, DIG. 7; 220/628, 630; 206/505, 509

[56] References Cited

U.S. PATENT DOCUMENTS

| | | | |
|---|---|---|---|
| 83,341 | 10/1868 | Towndrow | 215/377 |
| 600,427 | 3/1898 | Jones, Jr. | 215/377 |
| 809,567 | 1/1906 | Henckel | 215/377 |
| 2,169,426 | 8/1939 | Morton | 65/66 |
| 2,585,445 | 2/1952 | Dingeldein | 220/630 X |
| 2,918,188 | 12/1959 | Todd | 215/99.5 |
| 2,996,208 | 8/1961 | Schroeder | 215/377 |
| 3,079,037 | 2/1963 | Schechter | 220/630 X |
| 3,089,605 | 5/1963 | Buonauro | 215/377 |
| 3,482,731 | 12/1969 | Douty | 220/69 |
| 3,526,335 | 9/1970 | Swett et al. | 215/322 X |
| 3,987,930 | 10/1976 | Fuson | 206/509 X |
| 5,842,590 | 12/1998 | Gordon et al. | 215/10 |

FOREIGN PATENT DOCUMENTS

| | | | |
|---|---|---|---|
| 961785 | 1/1975 | Canada | 206/505 |
| 12009 | 6/1980 | European Pat. Off. | 215/372 |
| 1236001 | 6/1960 | France | 215/374 |
| 2282051 | 11/1990 | Japan | 220/630 |

*Primary Examiner*—Sue A. Weaver
*Attorney, Agent, or Firm*—Pearson & Pearson

[57] ABSTRACT

A two-piece, plastic, container particularly attractive for serving Margarita drinks and other well-known cocktails. A receptacle portion includes double flared side walls with a two-stage tapered plug on the bottom. The upper-stage of the plug secures the receptacle in a base portion and the lower stage of the plug provides for nesting of a plurality of receptacles to provide a compact and secure arrangement when packaged for shipping.

30 Claims, 6 Drawing Sheets

BI-NESTABLE CONTAINER FOR CONSUMABLES

This is a Continuation Application of U.S. application Ser. No. 08/691,215, filed Aug. 1, 1996, now U.S. Pat. No. 5,842,590.

BACKGROUND OF THE INVENTION

1. Field of the Invention

This invention relates to a container for drinks or cocktails and in particular to a two-piece, plastic, disposable, attractive double-flared container for serving a margarita or similar drinks.

2. Description of Related Art

In the prior art certain style containers have become associated with particular drinks such as for water, wine, beer, cocktails, etc. Other containers are used for packaging edible products and the cover is designed to function as a support base for a receptacle.

U.S. Pat. No. 2,918,188 issued Dec. 22, 1959 to E. K. Todd discloses an elongated container having a removable base with four depending teeth or tongs. U.S. Pat. No. 2,966,208 issued Mar. 29, 1961 to Paul A. Schroeder discloses an elongated container having members which may be used as a lid or a support base. U.S. Pat. No. 3,089,605 issued May 14, 1963 to Frank A. Bounauro discloses a two-part convertible container with a dual purpose as a storage vessel and also as a serving vessel. However, none of the above patents disclose an attractive double-flared receptacle, which is intended for serving a cocktail such as a margarita or other similar cocktail having a dual stage plug at a lower end that enables the packaging of a plurality of receptacles in a nesting configuration that minimizes or eliminates damage to the receptacles during shipment.

SUMMARY

Accordingly, it is therefore an object of this invention to provide a low cost, two-piece container having a double-flared receptacle portion with a two-stage plug on the bottom and a support base portion with a receiving socket for the plug.

It is an object of this invention to provide a low cost, plastic container having pieces which are nestable for safe, compact shipping purposes.

It is still another object of this invention to provide a receptacle portion of a container having a two-stage plug on the bottom, the lower stage being used for nesting a plurality of the receptacles for safe packaging and shipping.

It is another object of this invention to provide a two-piece container with support bases of different heights such as a tall base and a short base.

It is yet another object of this invention to provide a very attractive double-flared serving vessel for cocktails such as a margarita.

In accordance with one aspect of this invention a container for consumables, such as drinks and food, includes a one-piece receptacle for receiving contents that has a sidewall forming an open end, a lower end spaced from open the end for closing the receptacle and a plug extending from the lower end. A one-piece support base supports the receptacle and includes a base portion with a hollow stem extending from the base portion to an upper end. A socket formed in the upper end receives the plug. A single receptacle and base therefore can be formed into an integral container for use. Alternatively plural receptacles can be nested to form an assembly of receptacles and plural bases can be nested to form an assembly of bases.

In accordance with another aspect of this invention, a nestable support base for supporting a receptacle to form a container includes an integrally molded base portion and hollow stem. The stem terminates at an upper end to support the receptacle whereby a single receptacle and base can be formed into a container for use and whereby plural support bases can be nested.

The objects are further accomplished by providing a two piece container for serving drinks comprising a receptacle having an open top and a closed bottom with a sidewall of varying diameter between the open top and the closed bottom, a base means for supporting the receptacle, and the bottom of the receptacle comprises a tapered plug having an upper stage means for securing the receptacle to the base and a lower stage means having a smaller diameter than the upper stage means for providing nesting of a plurality of the receptacles when separated from the base means. The container comprises plastic material. The base means comprises a stem which includes an open cylindrical top portion having a smaller diameter than a lower portion of the stem. The lower portion of the stem being tapered from an upper smaller diameter to a lower larger diameter. The tapered stem of the receptacle being nestable when separated from the container by positioning a plurality of stems, one inside the other, each of the plurality of stems having stop means inside the stem protruding radially a predetermined distance toward the center of the hollow stem. The nesting of the plurality of the receptacles when separated from the base means comprises inserting the lower stage means of one of the plurality of the receptacles into the upper stage means of another of the plurality of the receptacles.

The objects are further accomplished by providing a two piece container for serving a margarita drink and other cocktails or food comprising a receptacle having an open top and a closed bottom with a double-flared sidewall of varying diameter in between the open top and the closed bottom, the diameter of the open top of an upper-flared portion of the receptacle being greater than the diameter of the top of a lower-flared portion which is greater than the diameter of the bottom, a base means for supporting the receptacle, and the bottom of the receptacle comprises a tapered plug having an upper stage for securing the receptacle to the base means and a lower stage having a smaller diameter than the upper stage for providing nesting of a plurality of the receptacles when separated from the base means. The base means comprises a stem which includes an open cylindrical top portion having a smaller diameter than a lower portion of the stem. The lower portion of the stem being tapered from an upper smaller diameter to a lower larger diameter. The nesting of the plurality of the receptacles when separated from the base means comprises inserting the lower stage means of one of the plurality of the receptacles into the upper stage means of an adjacent one of the plurality of the receptacles.

The objects are further accomplished by a method of providing a two piece container for serving drinks comprising the steps of providing a receptacle having an open top and a closed bottom with a sidewall of varying diameter between the open top and the closed bottom, supporting the receptacle with a base means, and securing the receptacle to the base with an upper stage of a tapered plug on the bottom of the receptacle, a lower stage means of the plug having a smaller diameter than the upper stage means for providing nesting of a plurality of the receptacles when separated from the base means. The method includes providing the container comprising the receptacle and the base means made of plastic material. The step of the base means supporting the receptacle comprises the step of providing the base means with a stem which includes an open cylindrical top portion having a smaller diameter than a lower portion of the stem. The step of the base means supporting the receptacle includes the step of providing the lower portion of the tapered stem with an upper smaller diameter extending to a lower larger diameter. The step of providing the tapered stem further comprises the step of nesting a plurality of the stems when separated from the receptacle by positioning the plurality of stems, one inside the other, each of the plurality of stems having stop means inside the stem protruding radially a predetermined distance toward the center of the hollow stem. The step of securing the receptacle to the base means with the tapered plug includes the step of providing the lower stage means of the plug for enabling the nesting of a plurality of the receptacles when the receptacle is separated from the container. The step of providing nesting of a plurality of the receptacles when separated from the container comprises the step of inserting the lower stage means of one of the plurality of the receptacles into the upper stage means of an adjacent one of the plurality of the receptacles.

The objects are further accomplished by a method of providing a two piece container for serving a margarita drink and other cocktails or food comprising the steps of providing a receptacle having an open top and closed bottom with a double-flared sidewall of varying diameter between the open top and the closed bottom, the diameter of the open top of an upper-flared portion of the receptacle being greater than the diameter of the top of a lower-flared portion which is greater than the diameter of the bottom, supporting the receptacle with a base means, and securing the receptacle to the base means with an upper stage of a tapered plug and a lower stage of the tapered plug having a smaller diameter than the upper stage for providing nesting of a plurality of the receptacles when separated from the base means.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
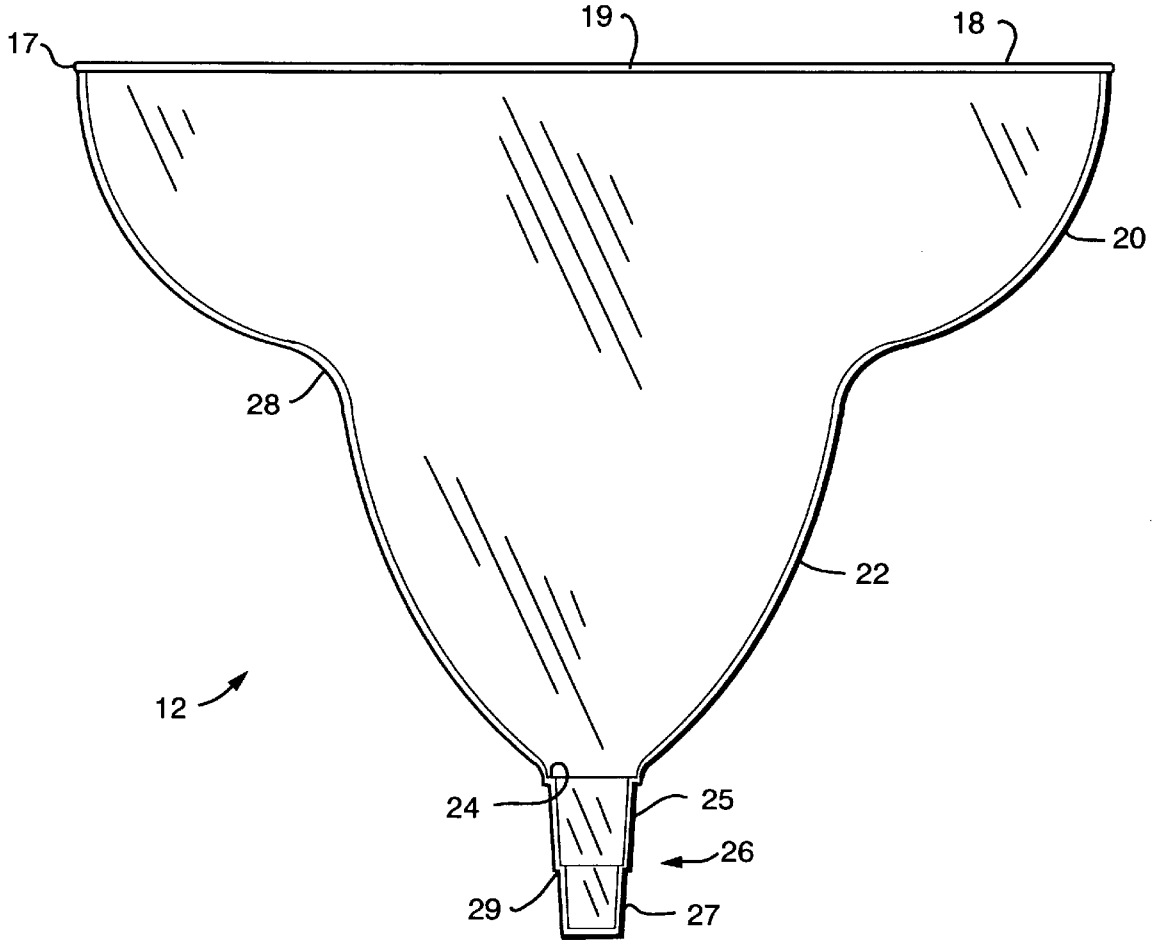
FIG. 1 is a side elevational view of a receptacle portion of the invention.
Figure 2:
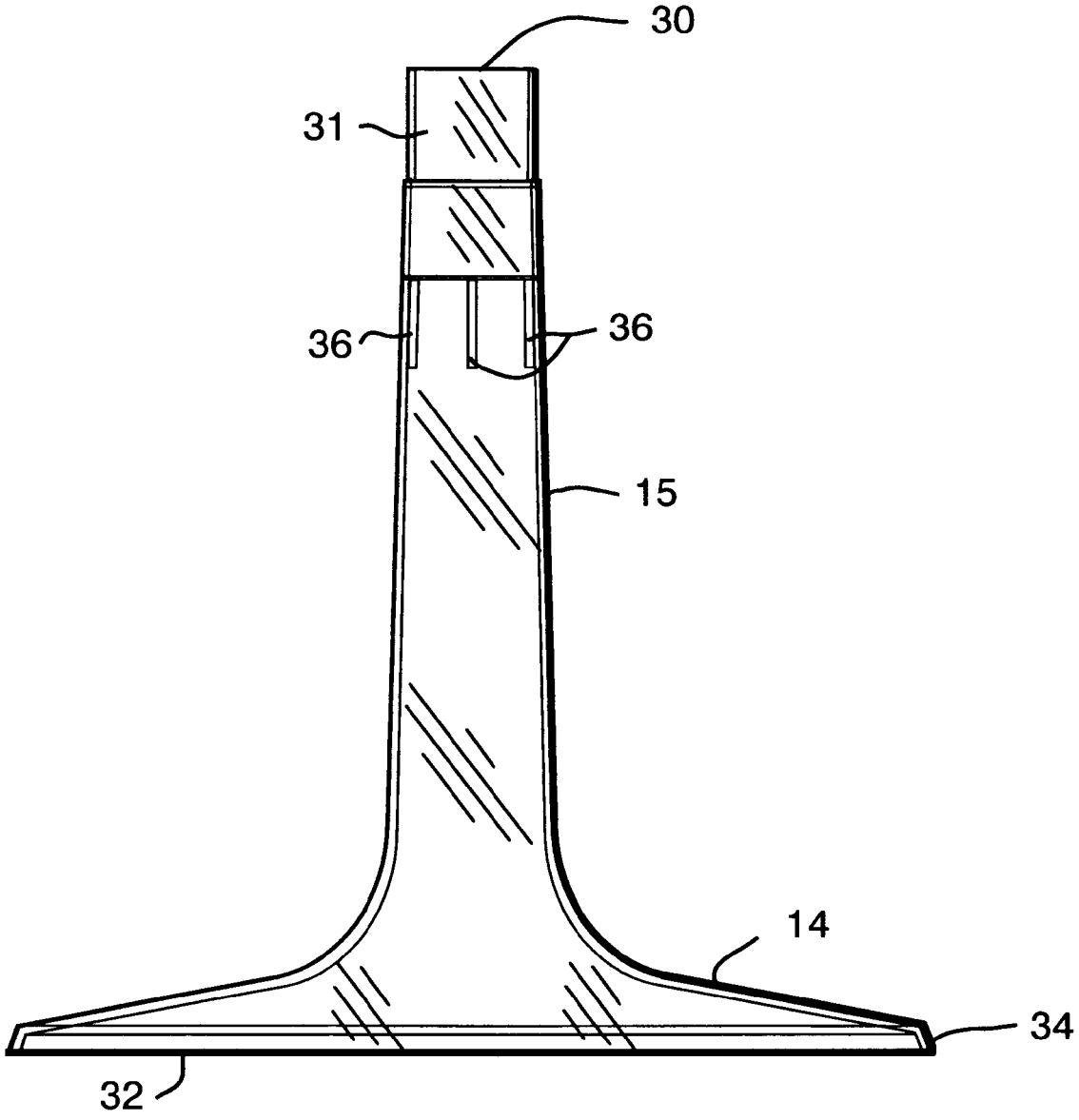
FIG. 2 is a side elevational view of a first embodiment of a tall support base portion of the invention.
Figure 3:
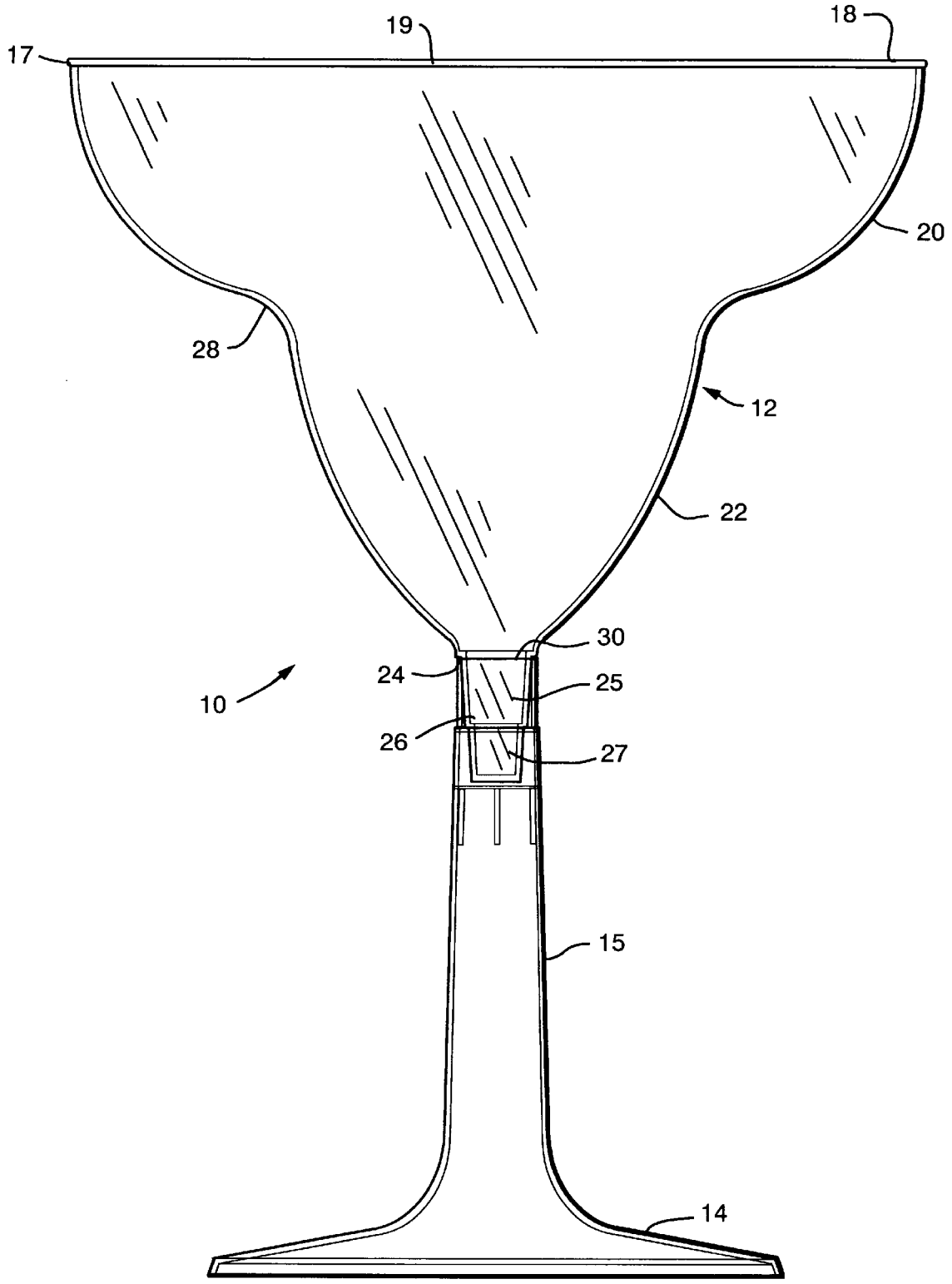
FIG. 3 is a side elevational view illustrating the receptacle of FIG. 1 supported on base of FIG. 2.
Figure 4:
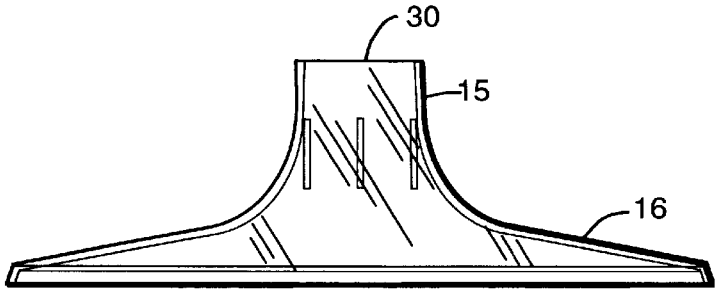
FIG. 4 is a side elevational view of a second embodiment of a short support base portion of the invention.

Referring to FIG. 1, FIG. 2 and FIG. 3, FIG. 3 shows a side elevational view of the invention of a cocktail container 10 comprising a receptacle 12 supported by a tall support base 14. FIG. 2 is a side elevational view of the tall support base 14; FIG. 4 dipicts a short base 16. FIG. 1 shows a side elevational view of the receptacle 12 which includes double-flared or teardrop shaped side walls 20, 22 which converge downward from an open end 18 to a lower end 24 and terminates in a downwardly projection dual stage hollow tapered plug 26. Such a double-flared or teardrop shaped receptacle 12 is often referred to as a "Margarita glass" even though it may not be made of glass and also referred to as "Margarita Stemware". The container 10 is used for other types of drinks such as "island" drinks and other similar cocktails or "frozen" drinks and further may be used for serving appetizers such as shrimp cocktails and desserts.

Figure 6:
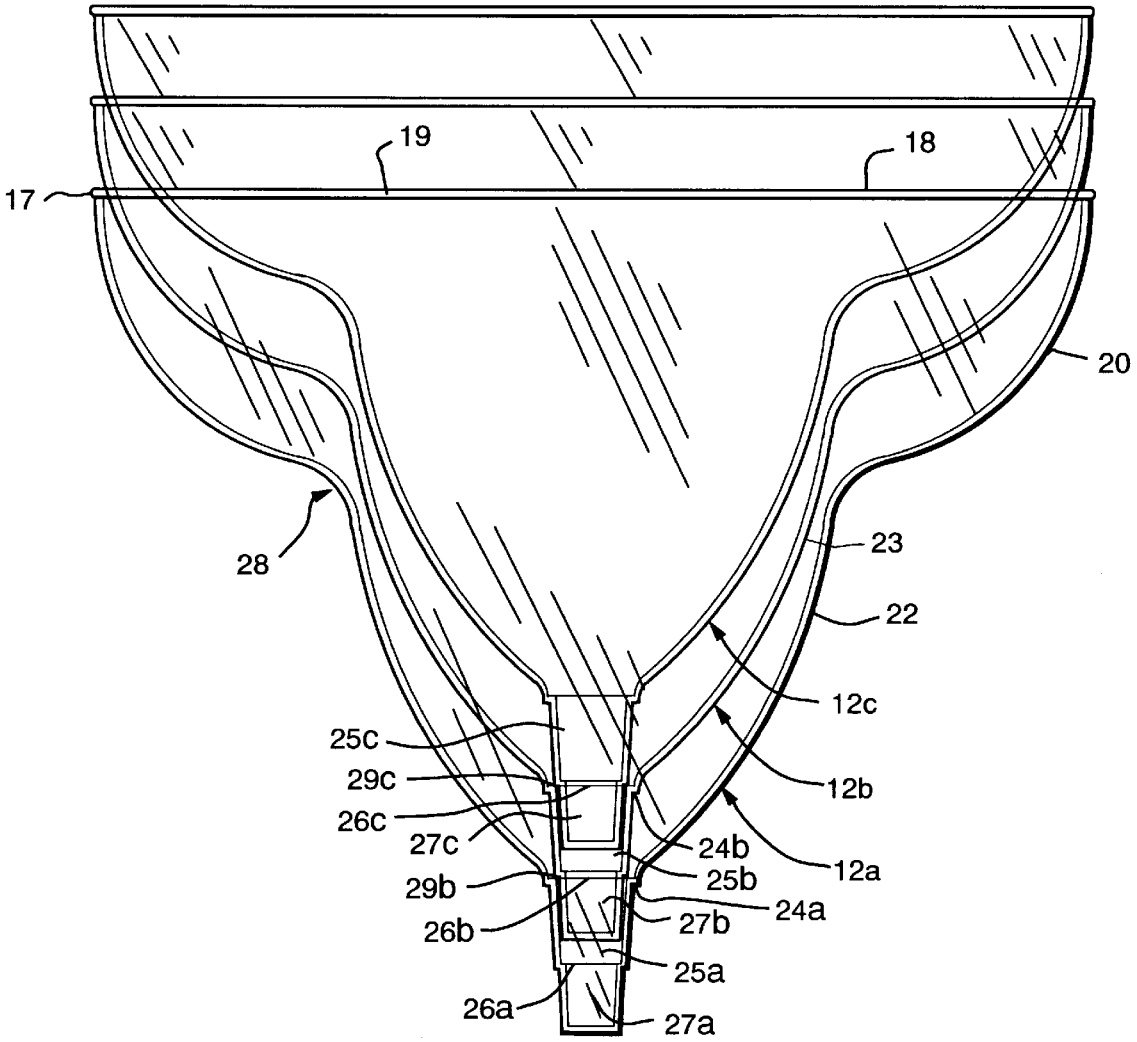
FIG. 6 is a side elevational view showing the nesting of three receptacles by means of the lower stage of the tapered plug of the receptacle.
Figure 7:
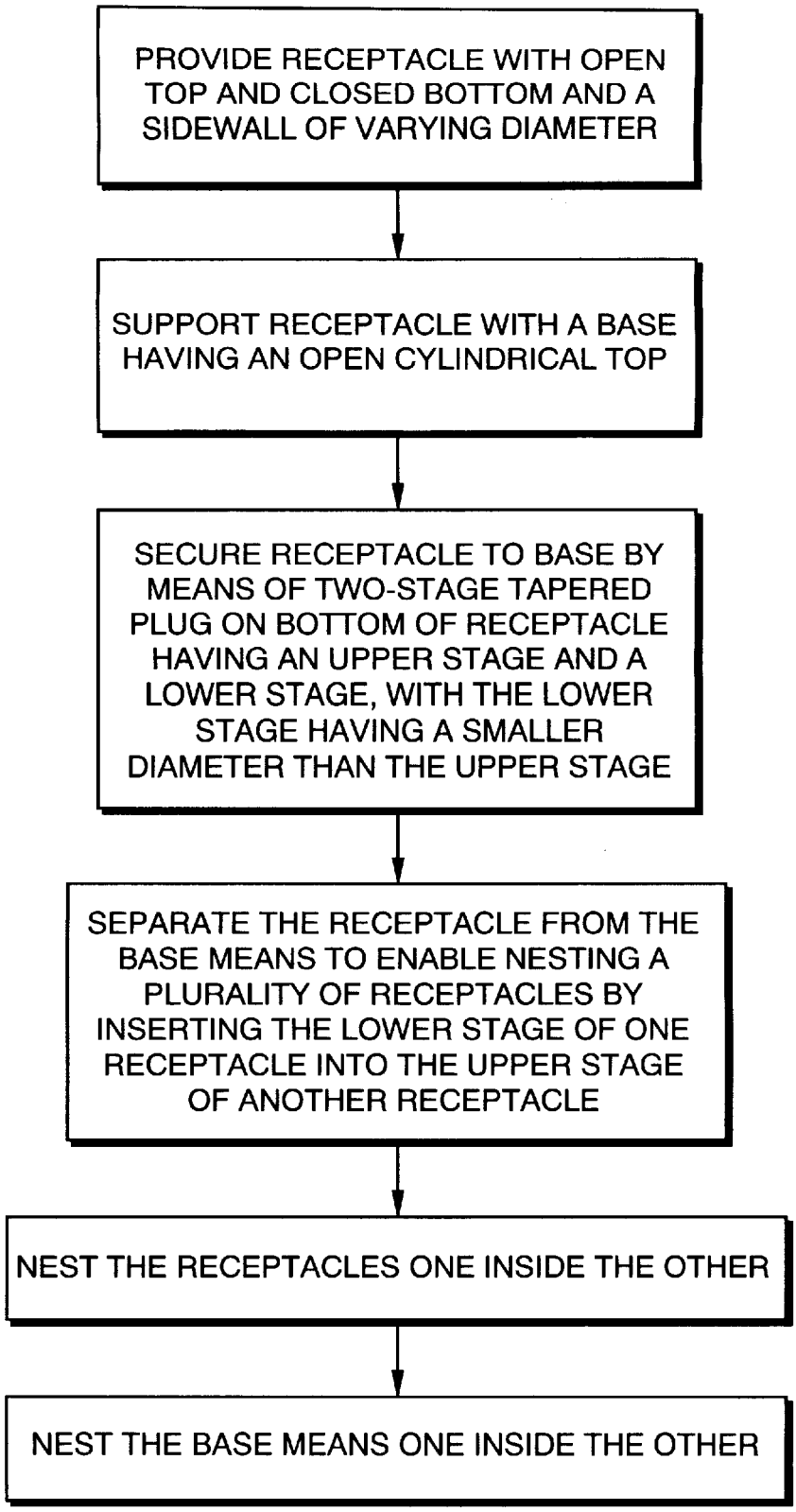
FIG. 7 is a flow diagram of the steps for the method of providing a two-piece container having nestable portions for serving drinks or for serving food.

Referring now to FIG. 1, FIG. 2, and FIG. 4, the upper stage 25 and lower stage 27 of plug 26 are each slightly tapered and the upper stage 25 is approximately ⅜ inch long and the lower stage 27 is approximately ¼ inch long although other lengths are equally feasible. The interface between the upper stage 25 and the lower stage 27 forms a shoulder 29 that constitutes an external stop projection that defines an internal stop plane. The tapering of upper stage 25 facilitates a tight fit when the plug 26 is inserted into the open end of socket 30 of base 14 and base 16 and the tapering of the lower stage 27 facilitates a secure fit when the receptacles 12 are nested for packaging and shipping as shown in FIG. 6.

Referring again to FIG. 1, the top of the upper flared portion formed by side wall 20 of receptacle 12 comprises the open end 18. The transition point 28 or top of the lower flared portion formed by sidewall 22, which resembles a truncated ellipse, is approximately one-half of the diameter of the open end 18, although other various diameters for the open end 18 and the transition point 28 are equally feasible. The preferred embodiment of the invention is fabricated from inexpensive material such as polystyrene plastic which provides thin but sturdy walls 20, 22. The upper peripheral edge 17 of the cocktail container 10 is provided with an overhang or outwardly projecting, continuous lip or bend 19.

Referring again to FIG. 2, an embodiment of a tall support base 14 is shown. The upper end of the base 14 is open and functions as a socket 30 for receiving the dual stage tapered plug 26 of the receptacle 12. The neck 31 of the base 14 is slightly narrower than the remainder of the stem 15 which tapers outward moving downward to a lower end 32 which flares out to provide a stable base portion; that is, the hollow stem 15 tapers from the base portion defined the lower end 32 to a point adjacent the socket. The lower end 32 is open and dimensioned to provide a stable cocktail container 10. The diameter of the lower end 32 is approximately midway between the diameter of the open end 18 of the receptacle 12 and the diameter of the transition point 28 at the top of the lower flared portion formed by sidewall 22. The lower end 32 of the base 14 is provided with a downwardly turned peripheral edge or skirt 34. The base is fabricated from plastic like the receptacle 12.

Referring to FIG. 3, the side view of the cocktail container 10 is shown with the receptacle 12 of FIG. 1 supported on the base 14 of FIG. 2. The receptacle 12 of FIG. 1 may also be supported on a short stem support base 16 as shown in FIG. 4. The tapered upper stage 25 of the plug 26 provides a tight connection for stability between the receptacle 12 and the base 14. The lower stage 27 does not contact the side of the base 14. The primary function of the lower stage 27 is to enable safe nesting of a plurality of the receptacles 12 for efficient packaging and nonbreakage during shipping as shown in FIG. 6.

Figure 5:
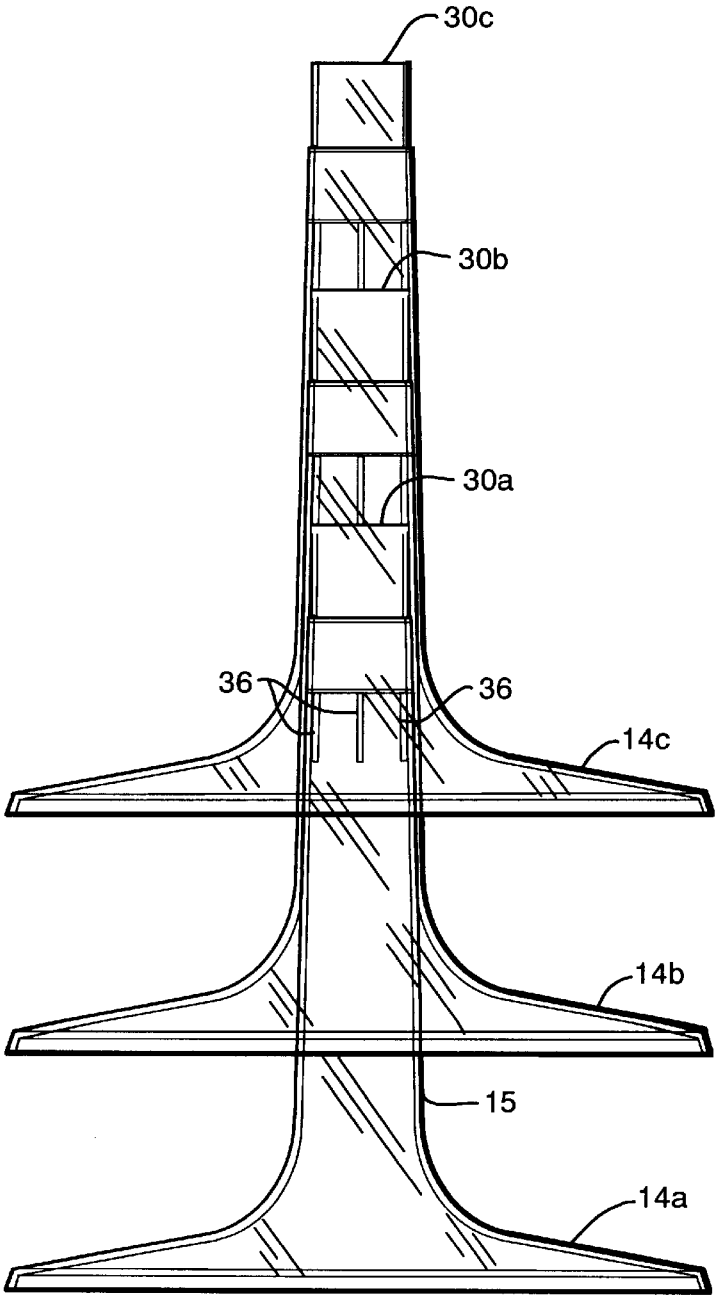
FIG. 5 is a side elevational view of three tall nested support bases.

Referring now to FIG. 4 and FIG. 5, FIG. 4 shows a side elevational view of an embodiment of the short support base 16. The stem 15 is reduced to be approximately two inches shorter than the stem of the base 14 shown in FIG. 2. In all other respects both bases 14, 16 are the similar.

Referring now to FIG. 5, three tall support bases are shown nested one on top of the other. Four vertical stops 36 are positioned every 90 degrees around the inside wall of each tall base 14*a*, 14*b*, 14*c* approximately 0.5 inches below the upper end at the socket 30*a* of the base 14*a*. These stops 36 that are above the base portion and adjacent the socket limit the distance that base 14*a* can be inserted in another base 14*b* and so on. That is, the bottoms of the stops 36 define an internal stop plane or shoulder for limiting the nesting depth of multiple bases. More specifically, as the base 14*a* is nested into the base 14*b*, the upper end of the socket 30*a* will engage the internal stop projection of the base 14*b*; likewise, the upper end of the socket 30*b* will engage the internal stop projection of the base 14*c*. Still another base could be added to the upper socket 30*c*. By maintaining a distance between the bases 14*a*, 14*b* and 14*c* in such a nesting configuration, any damage to said bases as a result of packaging and shipping is essentially eliminated.

Referring now to FIG. 6, the nesting of several receptacles 12*a*, 12*b*, 12*c* is shown. The lower stage 27*b* of receptacle 12*b* is inserted into the upper stage 25*a* of receptacle 12*a* until the shoulder 29*a*, that constitutes an external stop projection, engages that portion of the receptacle surrounding the upper stage 25*a* thereby to be stopped in a positive manner and causes the receptacle 12*b* to be centrally positioned whereby the sides of the receptacles 12*a* and 12*b* do not touch each other. Likewise, the lower stage 27*c* of receptacle 12*c* is inserted into the upper stage 25*b* of receptacle 12*b* until the shoulder 29*c*, that is at the interface of the upper stage 25*c* and the lower stage 27*c* and that constitutes the external stop projection, engages the lower end 24*b*. A continuous plurality of receptacles may continue to be nested, limited only by the size of a packaging container. Having plugs, such as the hollow plugs 26*a*, 26*b* and 26*c* in FIG. 6, the lower stages 27*a*, 27*b*, 27*c*, on each receptacle is a significant advantage in order to prevent damage to the receptacles, especially during shipping or transporting of packaged receptacles.

This invention has been disclosed in terms of certain embodiments. It will be apparent that many modifications can be made to the disclosed apparatus without departing from the invention. For example, the sizes of the receptacles 12 and the height of the support bases 14, 16 may vary. It may also be apparent that the subject container may have other applications besides serving drinks such as serving ice cream or serving shrimp by placing shrimp cocktail sauce in the bottom section of the receptacle and hanging shrimp around the peripheral top edge of the container. Therefore, it is the intent of the appended claims to cover all such variations, modifications and uses as come within the true spirit and scope of this invention.

What is claimed as new and desired to be secured by Letters Patent of the United States is:

1. A package for a plurality of containers comprising:

A) a plurality of one-piece receptacles for receiving contents, each said receptacle having an open top, a closed bottom, a sidewall, and an extended hollow, tapered plug having a closed end, an open end in communication with said receptacle and an external stop projection, said receptacles being nested with one receptacle being nested in another receptacle to a depth determined by the position of said external stop projection of said other receptacle, and B) a plurality of one-piece support bases for supporting said receptacles, each said base including an elongated, hollow stem terminating with a socket with an internal stop projection, said bases being nested with one base being nested in an other base to a depth determined by the position of said internal stop projection of the other base, said plug and socket enabling a single receptacle and base to be formed into a container for use.

2. A container as recited in claim 1 wherein each said internal stop projection is formed of material molded internally of said socket of said hollow stem.

3. A container as recited in claim 1 wherein each said support base includes a base portion for supporting said hollow stem and means formed internally of said socket of said hollow stem above said base portion and spaced from said upper end of said socket for defining said internal stop projection, said base portion having an aperture therethrough in line with said hollow stem.

4. A container as recited in claim 3 wherein each said socket has an internal cylindrical shape and each said plug tapers.

5. A container as recited in claim 4 wherein each of said receptacles and said support bases is formed of plastic.

6. A container as recited in claim 1 wherein each said hollow stem extends from a base portion and tapers to said socket.

7. A container as recited in claim 6 wherein each said internal stop projection is formed of a material molded internally of said socket of said hollow stem.

8. A container as recited in claim 7 wherein each said socket has an internal cylindrical shape and said plug tapers.

9. A container as recited in claim 8 wherein each said receptacle and said support base is formed of plastic.

10. A container as recited in claim 6 wherein each said support base includes a base portion for supporting said hollow stem and means formed internally of said socket of said hollow stem above said base portion and spaced from said upper end for defining said internal stop projection, said base portion having an aperture therethrough in line with said hollow stem.

11. A beverage container comprising:

A) a one-piece receptacle for receiving a beverage, said receptacle having a sidewall forming an open end, a lower end spaced from said open end and a closed end, hollow plug extending from said lower end for closing said receptacle, said hollow plug including means for defining an external receptacle stop plane and having its open end in communication with said receptacle, and B) a one-piece support base for supporting said receptacle including a base portion and a hollow stem extending from said base portion to an upper end, a socket being formed at said upper end to receive said plug, said support base including means formed internally of said socket for defining an internal base stop plane wherein said receptacle can be nested in an other receptacle with said hollow plug inserted into the hollow plug of said other receptacle to a depth determined by said receptacle stop plane to form an assembly of receptacles and wherein an other base can be nested in said base to form an assembly of bases with the hollow stem of said other base being inserted to a depth determined by said base stop plane of said base.

12. A container as recited in claim 11 wherein said base stop plane means comprises means for forming an internal shoulder spaced from said upper end of said hollow stem.

13. A container as recited in claim 11 wherein said external receptacle stop plane means comprises an external shoulder located at an intermediate position along said plug.

14. A container as recited in claim 11 wherein each said socket has an internal cylindrical shape and each said plug tapers.

15. A container as recited in claim 14 wherein each of said receptacles and said support bases is formed of plastic.

16. A container as recited in claim 11 wherein each said hollow stem extends from a base portion and tapers to said socket.

17. A container as recited in claim 16 wherein said base stop plane means comprises means for forming an internal shoulder spaced from said upper end of said hollow stem.

18. A container as recited in claim 16 wherein said external receptacle stop plane means comprises an external shoulder located at an intermediate position along said hollow plug.

19. A container as recited in claim 16 wherein each said socket has an internal cylindrical shape and said plug tapers.

20. A container as recited in claim 19 wherein each said receptacle and said support base is formed of plastic.

21. A nestable support base for supporting a receptacle to form a container, said nestable support base including an integrally molded base portion and hollow stem extending from said base portion and terminating at an upper end in a socket for supporting the receptacle whereby the receptacle and said base can be formed into the container for uses, said base additionally comprising an internal shoulder whereby an other base can be nested in said hollow stem of said base to a depth determined by said internal shoulder.

22. A support base as recited in claim 21 wherein said internal shoulder is formed internally of said socket and spaced from said upper end.

23. A support base as recited in claim 21 wherein said internal shoulder comprises a plurality of equiangularly spaced parallel projections formed internally of said receptacle socket and spaced from said upper end thereof.

24. A support base as recited in claim 23 wherein said socket has an internal cylindrical shape.

25. A support base as recited in claim 24 wherein said support base is formed of plastic.

26. A support base as recited in claim 21 wherein said hollow stem tapers from said base portion to said socket.

27. A support base as recited in claim 26 wherein said internal shoulder comprises a plurality of equiangularly spaced parallel projections formed internally of said socket and spaced from said upper end.

28. A support base as recited in claim 26 wherein said internal shoulder is formed internally of said socket and spaced from said upper end.

29. A support base as recited in claim 28 wherein said socket has an internal cylindrical shape.

30. A support base as recited in claim 29 wherein said support base is formed of plastic.

* * * * *